US009237622B2

(12) United States Patent
Mork et al.

(10) Patent No.: US 9,237,622 B2
(45) Date of Patent: Jan. 12, 2016

(54) POWER SUPPLY FOR A FIELD EMISSION LIGHT SOURCE

(71) Applicant: Lightlab Sweden AB, Uppsala (SE)

(72) Inventors: Goran Mork, Stocksund (SE); Jonas Tiren, Uppsala (SE)

(73) Assignee: LIGHTLAB SWEDEN AB, Uppsala (SE)

( * ) Notice: Subject to any disclaimer, the term of this patent is extended or adjusted under 35 U.S.C. 154(b) by 0 days.

(21) Appl. No.: 14/369,235

(22) PCT Filed: Dec. 21, 2012

(86) PCT No.: PCT/EP2012/076661

§ 371 (c)(1),
(2) Date: Jun. 27, 2014

(87) PCT Pub. No.: WO2013/098239

PCT Pub. Date: Jul. 4, 2013

(65) Prior Publication Data

US 2014/0361700 A1 Dec. 11, 2014

(30) Foreign Application Priority Data

Dec. 28, 2011 (EP) ..... 11195938

(51) Int. Cl.

| | |
|---|---|
| ***H05B 41/14*** | (2006.01) |
| ***H05B 41/233*** | (2006.01) |
| ***H05B 33/08*** | (2006.01) |
| ***H01J 63/06*** | (2006.01) |

(52) U.S. Cl.

CPC ..... *H05B 33/0854* (2013.01); *H01J 63/06* (2013.01); *H05B 33/0815* (2013.01); *H05B 33/0896* (2013.01); *H05B 41/233* (2013.01)

(58) Field of Classification Search

CPC ..... H02M 3/335; H05B 41/233; H01J 63/06
USPC ..... 315/200 R, 247, 268, 274, 307, 354; 313/310; 363/17, 61, 98
See application file for complete search history.

(56) References Cited

U.S. PATENT DOCUMENTS

| | | | | |
|---|---|---|---|---|
| 7,324,354 | B2 * | 1/2008 | Joshi et al. | 363/17 |
| 2007/0008745 | A1 * | 1/2007 | Joshi et al. | 363/21.01 |
| 2010/0097004 | A1 | 4/2010 | Herring et al. | |
| 2015/0015166 | A1 * | 1/2015 | Liu et al. | 315/340 |

FOREIGN PATENT DOCUMENTS

| | | |
|---|---|---|
| EP | 0035828 A2 | 9/1981 |
| WO | 9107006 A1 | 5/1991 |

OTHER PUBLICATIONS

PCT International Search Report dated Apr. 22, 2013 for PCT International Application No. PCT/EP2012/07661, 3 pages.

* cited by examiner

*Primary Examiner* — Daniel D Chang
(74) *Attorney, Agent, or Firm* — Remarck Law Group PLC

(57) ABSTRACT

The present invention relates to a power supply for a field emission light source. The novel power supply allows for a reduction in size as well as allowing for improvements relating to power factor and efficiency. The size reduction further allows the power supply to efficiently be integrated together with the field emission light source forming a lighting device.

14 Claims, 3 Drawing Sheets

POWER SUPPLY FOR A FIELD EMISSION LIGHT SOURCE

CROSS-REFERENCE TO RELATED APPLICATIONS

This application is a 371 U.S. National Stage of International Application No. PCT/EP2012/076661, filed Dec. 21, 2012, which claims priority to EPC No. 11195938.3, filed Dec. 28, 2011. The disclosure of each of the above applications is incorporated herein by reference in their entirety.

FIELD OF THE INVENTION

The present invention relates generally to the field emission, and specifically to a compact power supply suitable for use with a field emission light source. The present invention also relates to field emission light source comprising the power supply.

TECHNICAL BACKGROUND

Traditional incandescent light bulbs are currently being replaced by other light sources having higher energy efficiency and less environmental impact. Alternative light sources include light emitting diode (LED) devices and fluorescent light sources. However, LED devices are expensive and complicated to fabricate and fluorescent light sources are known to contain small amounts of mercury, thereby posing potential health problems due to the health risks involved in mercury exposure. Furthermore, as a result of the mercury content, recycling of fluorescent light sources is both complicated and costly.

An attractive alternative light source has emerged in the form of field emission light sources. A field emission light source includes an anode and a cathode, the anode consists of a transparent electrically conductive layer and a layer of phosphor coated on the inner surface of e.g. a transparent glass tube. The phosphor layer emits is made luminescent when excited by electrons. The electron emission is caused by a voltage between the anode and the cathode. For achieving high emission of light it is desirable to apply the voltage in a range of 2-12 kV.

A suggested power supply provided in conjunction with such a field emission light source is disclosed in US2008185953. In US2008185953, the power supply comprises a bridge rectifier and filtering components, to prevent undesirable emissions, and a voltage-multiplying rectifier for providing high voltage suitable for anode to cathode power of the field emission light source.

However, the implementation of US2008185953 provides undesirable disadvantages in relation to size of the power supply as well as in relation to the efficiency of the power supply. The disadvantages generally derive from the introduction of a large plurality of steps within the voltage multiplier.

Accordingly there is a need for an improved high voltage power supply for a field emission light source, specifically taking into account size of the power supply for allowing integration of the power supply together with the field emission light source.

SUMMARY OF THE INVENTION

In view of the above-mentioned and other drawbacks of the prior art, a general object of the present invention is to provide an improved power supply for a field emission light source.

According to a first aspect of the present invention, it is provided a power supply for a field emission light source, comprising a DC-DC converter configure to receive a source of direct current at a first voltage level, at an input of the DC-DC converter, and to provide a direct current at a second voltage level, at an output of the DC-DC converter, the second voltage level being higher than the first voltage level, a resonant inverter comprising a transformer, the resonant inverter connected to the output of the DC-DC converter and configured to provide a pulsating signal at a first frequency having a third voltage level, the third voltage level being higher than the second voltage level, and a voltage multiplier rectifying the pulsating signal to a direct current at a fourth voltage level, the fourth voltage level being higher than the third voltage level, the voltage multiplier comprising a pair of output terminals for connecting to the field emission light source, wherein the power supply further comprises a control unit for controlling the resonant inverter based on a (e.g. current and/or voltage) feedback relating to the operation of the field emission light source provide from the voltage multiplier.

The present invention is based on the realization that by introducing a control unit connected to e.g. the voltage multiplier (typically comprising a plurality of diode-capacitor stages) and the resonant inverter, feedback signals provided for example from the voltage multiplier may be used allowing a smoother control of the connected field emission light source. Specifically when working with high voltage applications, the introduction of e.g. voltage spikes may effectively limiting the lifetime of the field emission light source, even directly "burn out".

In addition, by means of introducing the control unit, it will be possible to provide a both visually and for video recording acceptably small temporal light output variation, both the high voltage inverter input level, the voltage multiplier voltage tapped at a convenient stage and the voltage multiplier input and output currents may be sampled. A straightforward regulation of the multiplier output current may not be feasible because of the time lag caused by the voltage multiplier capacitors. Instead an algorithm based control of the high voltage inverter frequency and thereby the output power may be used. The algorithm could be used for correcting any nonlinearity of the sampled values i.e. by using lookup tables.

Dimming of the lamp may further complicate the regulation as frequency and input voltage control ranges may be too limited to allow for the desired dimming range. As will be described further, an on-off modulation of the high voltage inverter could according to an embodiment be used, still meeting the light output variation requirements.

It should be further noted that the implementation as is provided by the invention place the circuit resonance on the secondary side of the transformer, this in comparison to the normal case where the circuit resonant is present on the primary side of the transformer.

Preferably, the reception of the source of direct current at a first voltage level is provided as a rectified voltage signal from a mains supply. That is, in an example the mains supply is provided at 90-140 VAC (RMS) at 60 Hz, or in another example at 190-270 VAC (RMS) at 50 Hz, which is then rectified (e.g. full-wave rectification) resulting in a rippled DC signal having an average voltage level being slightly less than the RMS voltage level of the mains supply as exemplified above. Accordingly, the power supply may optionally comprise a rectifier, such as a rectifier for providing full-wave rectification.

Within the context of the application, the first voltage level is according to an embodiment this rectified mains supply. However, the source of a direct current may also be an essentially constant DC source, where there possibly may be superimposed a control signal with the DC signal received by the control unit for controlling the power supply.

Furthermore, the second voltage level is as higher than the first voltage level. Within the context of the application, this should be interpreted as an average of the second voltage level being higher than the average of the first voltage level. Typically, in case of providing an alternating mains supply, the second voltage level may be allowed to ripple, possibly with a ripple voltage up to 100 V. Preferably, the second voltage level may be set to not exceed 700 V.

Still further and as discussed above, the resonant inverter is typically configured to provide a pulsating signal at a first frequency having a third voltage level, the third voltage level being higher than the second voltage level, Within the context of the application, the first frequency may be selected from a frequency range between 0-200 kHz. It should be noted that the first frequency may be adjusted during operation of the power supply, i.e. within the above mentioned frequency range. Preferably, the third voltage level is around 1 kV with a peak to peak value of around 3 kV to allow for cost effective dry isolated transformers.

In addition, the voltage multiplier is configured to provide a direct current at a fourth voltage level, preferably not exceeding 10 kV (in an exemplary embodiment). However, it is of course possible and within the scope of the invention to allow the fourth voltage level to be kept at an even higher maximum voltage level, e.g. exceeding 15-25 kV. The selection of maximum voltage level of course depends on the specific implementation of the power supply.

As mentioned above, the control unit may also allow for dimming of the field emission light source by controlling the resonant inverter. The power supply may be configured to be dimmable by means of a conventional triac based dimmer. However, use of a triac dimmer may not be fully desirable as the triac dimmer will provide for a poor power factor and a high content of mains frequency overtones. Preferably, the control unit may be configured to receive a signal representing a light intensity of the field emission light source, and regulating the resonant inverter based on the light intensity signal, thereby allowing the field emission light source to provide an essentially steady lighting level, preferably independent of the remaining ripple of the DC-DC converter.

Additionally, the control unit is preferably also connected to the DC-DC converter. By means of such a configuration, the control unit may be further configured to, by means of feedback from e.g. the voltage multiplier, adaptively control e.g. the DC-DC converter for the purpose of maximizing the electrical efficiency of the power supply and providing a predefined dimming range.

In an embodiment, the control unit may be configured to include functionality for allowing a PWM (pulse with modulation) style control of the resonant inverter. Accordingly, the pulsating signal from the resonant inverter may during some instances be suppressed (i.e. some pulses may be excluded), thus effectively reducing the output from the following voltage multiplier, accordingly allowing the light source to be "dimmed" such that the intensity may be controlled.

The PWM control of the resonant inverter preferably is achieved taking into account the frequency of the mains supply. Possibly, and in regards to a mains frequency of 50 Hz (which effectively is doubled following a full-wave rectification), the PWM "base frequency" may be kept at a predetermined multiple for reducing fluctuations based on the mains frequency. In an embodiment the PWM base frequency is for example selected to be within the exemplary range of 600-900 Hz, preferably 800 Hz.

In another embodiment the PWM base frequency is selected based on a control protocol (e.g. DALI) used for controlling the power supply. Accordingly, a transmission frequency of the control protocol may be allowed to influence the selection of the PWM base frequency. Furthermore, the power supply is preferably comprised with the field emission light source thereby forming a lighting device, e.g. the power supply arranged together with (such as for example within a socket in the case the field emission light source) with or in the vicinity of the field emission light source. The power supply is preferably connected to a field emission cathode and an anode structure of the field emission light source and configured to provide a drive signal for powering the field emission light source. The voltage provided to the field emission light source is preferably in the range of 2-12 kV. Within the context of the description, the expression "field emission light source" should be interpreted broadly, thus including light sources (e.g. bulbs, tubes, etc) for general lighting as well as controllable multi color field emission displays.

The feedback of the level of light generated by the field emission light source may be achieved e.g. by using a "light drain concept", e.g. by using a pump stem of e.g. an evacuated glass body of the field emission light source. Accordingly, in arranging the power supply within a socket of the lighting device, it may be possible to position a PCB holding (e.g. the majority of) the components of the power supply such that a light sensor for collecting light and generating the light intensity level may be positioned directly on the PCB, i.e. without having to include cabling or similar, thereby minimizing any disturbance signals possibly introduced otherwise.

However, it should be noted that in regards to some types of field emission light sources, positioning of the light sensor onto the glass body of the field emission light source, or including e.g. an optical fiber for conveying an amount of light from the field emission light source to the light sensor, e.g. glued to the glass body of the field emission light source, may be advantageous and thus well in line with the inventive concept.

In an embodiment, the lack of any feedback of light from the field emission light source may indicate failure of the field emission light source and may as such be used for adapting the control unit to switch off the power supply. Thus, a risk reduction may be achieved since this functionality disallows any high voltage (as indicated above) to be provided to a malfunctioning field emission light source.

It is generally only necessary to collect a small portion of light from the field emission light source, e.g. as may be conveyed through a glass portion of the pump stem. That is, it is preferred to collect light from the field emission light source in such a manner such that the light sensor is refrained from saturate already when the field emission light source is only emitting an in comparison low level of light (as compared to the maximum amount of light to be emitted by the field emission light source). As such, the pump stem may act as a "filter" for reducing the amount of light to be collected by the light sensor.

In addition, the control unit may be adapted to implement a control regime for increasing the possible lifetime of the field emission light source by taking into account the current light output level in comparison to a rated light output level. In such an implementation it may be possible to optimize the lifetime of the field emission to emit light "as much as possible" corresponding to a predefined lifetime curve (e.g. a desired "aging" of the field emission light source).

Still further, in implementing a light feedback functionality the power supply may comprise an additional light sensor (e.g. arranged in the socket of the lighting device as discussed above and "light shielded" from the light emitted from the field emission light source) connected to the control unit for collecting an amount of ambient lighting, thereby adapting the light output level also based on the current level of ambient lighting.

In a similar manner, the lighting device may still further comprise e.g. an occupancy sensor (e.g. a PIR sensor) connected to the control unit for determining the presence of a person in the vicinity of the lighting device and adapting the lighting level emitted by the lighting device accordingly.

The power supply may in addition comprise a communication interface for receiving an external control signal, e.g. for controlling a calibration level of the field emission light source, or for controlling the lighting level during operation of the lighting device. Different communication interface, wired or wireless, may be possible, including for example ZigBee, Bluetooth, WLAN, DMX, RDM, etc.

According to a second aspect of the invention, there is provided a method for controlling a power supply configured to apply an adjustable voltage level to a light source, the power supply comprising a resonant inverter, wherein the method comprises determining a frequency for a signal configured to provide a operational power for the power supply, selecting a multiple of the frequency of the mains signal as a PWM base frequency, controlling the resonant inverter to stop producing an output for a predetermined duration based on PWM control of the resonant inverter at the selected PWM base frequency, thereby allowing an average voltage level to the light source to be controlled for controlling the intensity level of the light source.

As was discussed above, the functionality according to the inventive method may for example be implemented in a control unit communicatively coupled to the power supply. Accordingly, the pulsating signal from the resonant inverter may during some instances be suppressed (i.e. some pulses may be excluded), thus effectively reducing an average voltage level provided from the resonant inverter such that the light source may be dimmed.

The PWM control of the resonant inverter preferably is achieved taking into account the frequency of the mains supply. Possibly, and in regards to a mains frequency of 50 Hz (which effectively is doubled following a full-wave rectification), the PWM "base frequency" may be kept at a predetermined multiple for reducing fluctuations based on the mains frequency. In an embodiment the PWM base frequency is for example selected to be within the exemplary range of 600-900 Hz, preferably 800 Hz.

While the invention generally has been described in relation to a field emission light source, the method according to the invention could also possibly be applied in relation to other types of light sources, including for example light sources comprising light emitting elements such as LEDs, OLEDs, etc.

The expression "frequency for a mains signal" should within the context of the invention be interpreted broadly and as such not only including e.g. the 50 Hz mains frequency as discussed above. In an alternative embodiment the determined frequency may be based on a predetermined external frequency signal. Accordingly, any external synchronization signal may be provided, for example relating to control functionality for controlling a plurality of connected light sources having individual or somewhat connected power supplies. Such a control signal may for example include the above mentioned DALI protocol, or any of the DMX, RDN, etc., protocol.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

These and other aspects of the present invention will now be described in more detail with reference to the appended drawings showing an example embodiment of the invention, wherein.

DETAILED DESCRIPTION OF PREFERRED EMBODIMENTS OF THE INVENTION

Figure 1:
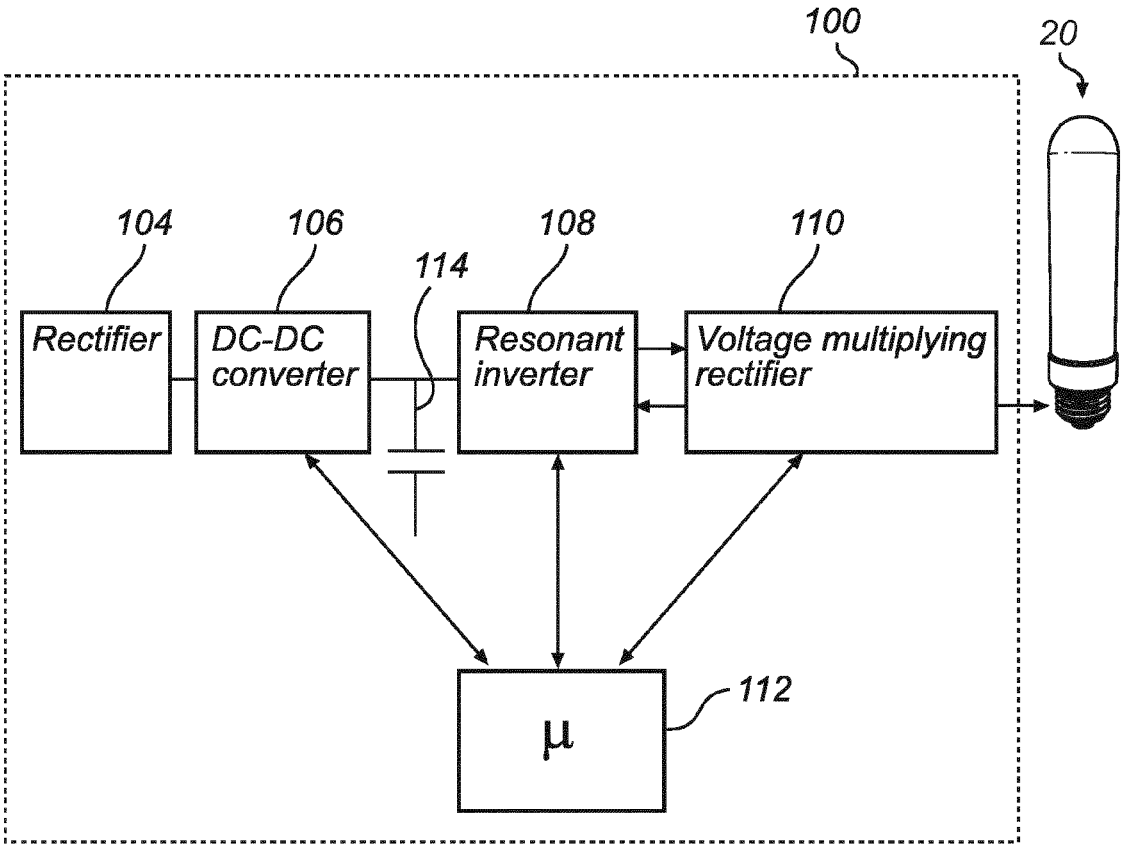
FIG. 1 schematically illustrates a power supply according to a currently preferred embodiment of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Turning now to FIG. 1 which schematically illustrates a power supply 100 for powering a field emission light source 102. The power supply 100 comprises a rectifier 104 for connection to an external AC supply (possibly providing an unfiltered output), such as a mains supply, and a PFC-Boost (DC-DC) converter 106 converter connected to the rectifier 104 and configure to receive a source of direct current at a first voltage level and to provide a direct current at a second voltage level (preferably having a reasonably low content of superimposed ripple), the second voltage level being higher than the first voltage level. Preferably, the rectifier comprises an EMC filter for minimizing disturbance possibly generated by the power supply 100 and/or the field emission light source 102.

The power supply further comprises an LLC resonant inverter 108 comprising a transformer, the resonant inverter connected to the output of the DC-DC converter 106 and configured to provide a pulsating signal at a first frequency having a third voltage level, the third voltage level being higher than the second voltage level. It should be noted that any type of resonant inverter may be included within the context of the invention, including for example an LLCC resonant inverter.

The output from the resonant inverter 108 is in turn connected to a voltage multiplier 110 rectifying the pulsating signal to a direct current at a fourth voltage level, the fourth voltage level being higher than the third voltage level, the voltage multiplier comprising a pair of output terminals for connecting to the field emission light source 102.

Additionally, the power supply 100 comprises a control unit 112 for controlling the resonant inverter 108 based on a feedback relating to the operation of the field emission light source provide from the voltage multiplier. The control unit 112 may include a microprocessor, microcontroller, programmable digital signal processor or another programmable device. The control unit 112 may also, or instead, include an application specific integrated circuit, programmable gate array programmable array logic, a programmable logic device, or a digital signal processor. Where the control unit 112 includes a programmable device such as the microprocessor or microcontroller mentioned above, the processor may further include computer executable code that controls operation of the programmable device.

Furthermore, as is shown in the illustrated embodiment, the power supply 100 additionally comprises a capacitor 114, connected to the output of the DC-DC converter 106. Preferably, for maximizing the lifetime of the power supply 100, the capacitor 114 is a non-electrolytic capacitor. The inventor has identified that the use of an electrolytic capacitor, as would be the common approach for the present type of power supply, drastically would limit the lifetime of the power supply. That is, an electrolytic capacitor generally has a lifetime of approximately a few thousand hours, and thus such a capacitor would not be suitable for use with a power supply for a long life implementation as is desired within the current context, where it would be desirable to with a power supply having a lifetime extending several ten thousand hours. In the exemplified implementation, the non-electrolytic capacitor has a capacitance lower than 0.15 uF/W of output power.

In using the field emission light source 102 as e.g. a light source for general lighting, it is often desirable to allow the luminous output from the light source to be varied, i.e. dimmed. Generally, when using an LLC resonant inverter there will be constrains on the possibility to vary the output from the LLC to achieve such a dimming functionality, with a maintained electrical efficiency of the power supply 100, i.e. without having increased losses when in fact decreasing the light output from the field emission light source 102.

According to the currently preferred implementation of the power supply 100, this is solved by adapt the control unit to control the DC-DC converter 106 such that the output from the DC-DC converter 106 also is varied when dimming of the light output is requested. Accordingly, in the disclosed embodiment the control unit 112 provides for the possibility to allow a cooperation to take place between the DC-DC converter 106 and the LLC resonant inverter 108 during the "dimming phase".

Specifically, the output (the third voltage level) from the DC-DC converter 106 may be decreased when a predetermined frequency boundary in regards to the control frequency for the LLC resonant inverter 108 is reached. For example, the control unit 112 may provide for an adjustment of the output from the DC-DC converter 106 based on feedback from the LLC resonant inverter 108 relating to operating frequency of the LLC resonant inverter 108, the output from the DC-DC converter possibly being a function of the operating frequency LLC resonant inverter 108.

Figure 2:
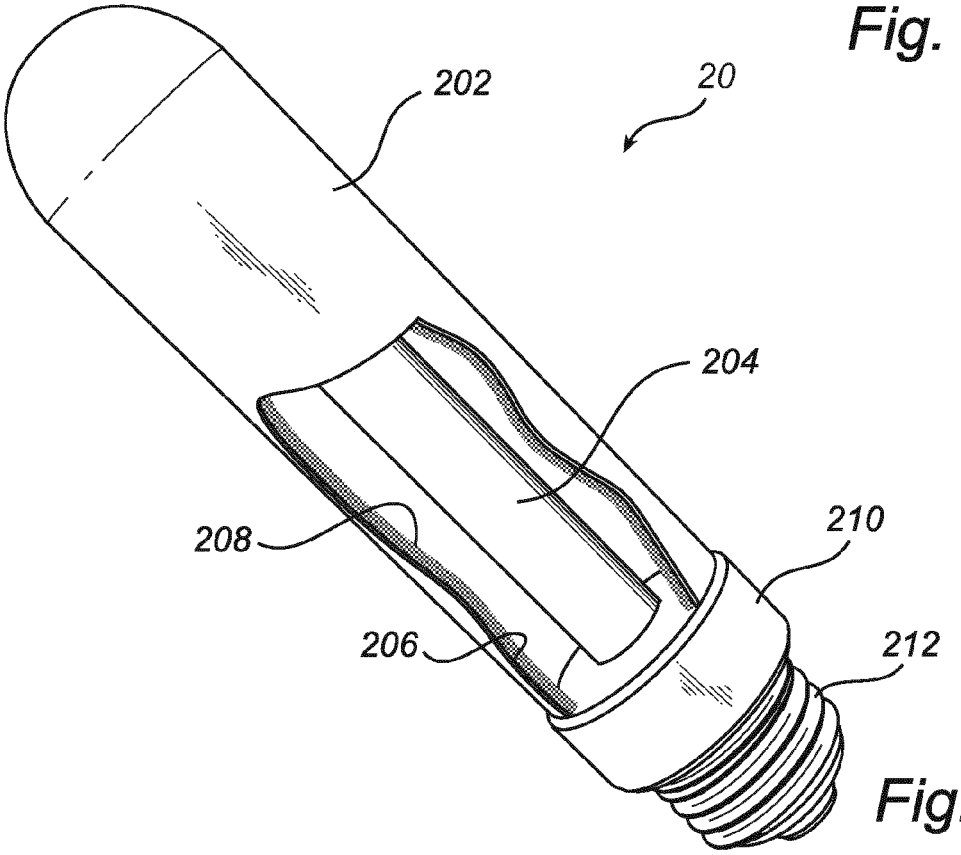
FIG. 2 conceptually illustrates lighting device comprising a field emission light source and the power supply of FIG. 1.

FIG. 2 illustrates a lighting device 20 comprising field emission light source 200 and a power supply 100 as discussed above arranged in the base 210 of the lighting device 20. The field emission light source 200 includes a cylindrical glass envelope 202 inside of which a field emission cathode 204 is (e.g. centrally) arranged. The field emission light source 200 illustrated in FIG. 2 is based on the concept of using a transparent field emission anode, such as an indium tin oxide (ITO) layer 206 being provided on a transparent envelope, such as the evacuated cylindrical glass bulb 202. For emission of light, a layer of phosphor 208 is provided inside of the ITO layer 206, in the direction towards a field emission cathode 204. The field emission cathode 204 may comprise a conductive substrate onto which a plurality of sharp emitters has been arranged, for example comprising ZnO nanostructures, including for example nano walls, nano tubes, etc. The sharp emitters may also comprise carbon based nanostructures (e.g. CNT etc.).

The base 210 includes a terminal 212, allowing for the lighting device 20 to be used for e.g. retrofitting conventional light bulbs. Within the concept of the invention, it is also possible to provide a similar tube based arrangement, having a similar form factor as e.g. T8, T5 fluorescent tubes, etc. Also, within the concept of the invention it is also possible to provide a flat field emission light source, e.g. having addressable (anode) sections possibly allowing for an adaptive "pixel" based control of the flat field emission light source, allowing the different pixels to emit light of different color, for example simultaneously. Accordingly, such a flat field emission light source may be used as a multi color display. The control functionality may be provided by the above discussed control unit.

The base 210 preferably comprises the power supply 100 as discussed above for providing a drive signals (i.e. high voltage) to the cathode 204. During operation of the field emission lighting application 200, an electrical field is applied between the cathode 204 and the anode layer, e.g. the ITO layer 206. By application of the electrical field, the cathode 204 emits electrons, which are accelerated towards the phosphor layer 208. The phosphor layer 208 may provide luminescence when the emitted electrons collide with phosphor particles of the phosphor layer 208, thereby exciting electrons which when recombining emits photons. Light provided from the phosphor layer 208 will transmit through the transparent ITO/anode layer 206 and the glass cylinder 202. The light is preferably white, but colored light is of course possible and within the scope of the invention. The light may also be UV light.

Figure 3A:
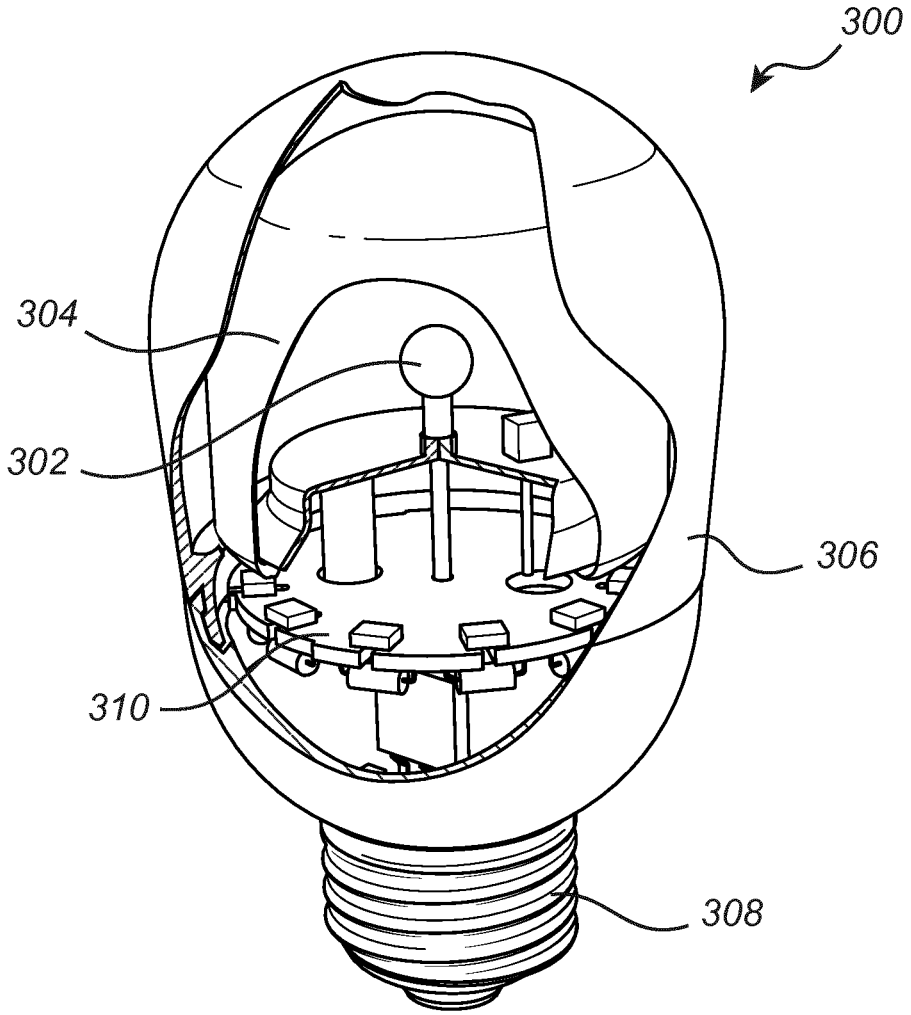
FIGS. 3*a* and 3*b* shows an overview as well as a detailed view, respectively, of a lighting device, where the field emission light source is adapted for feedback of light.
Figure 3B:
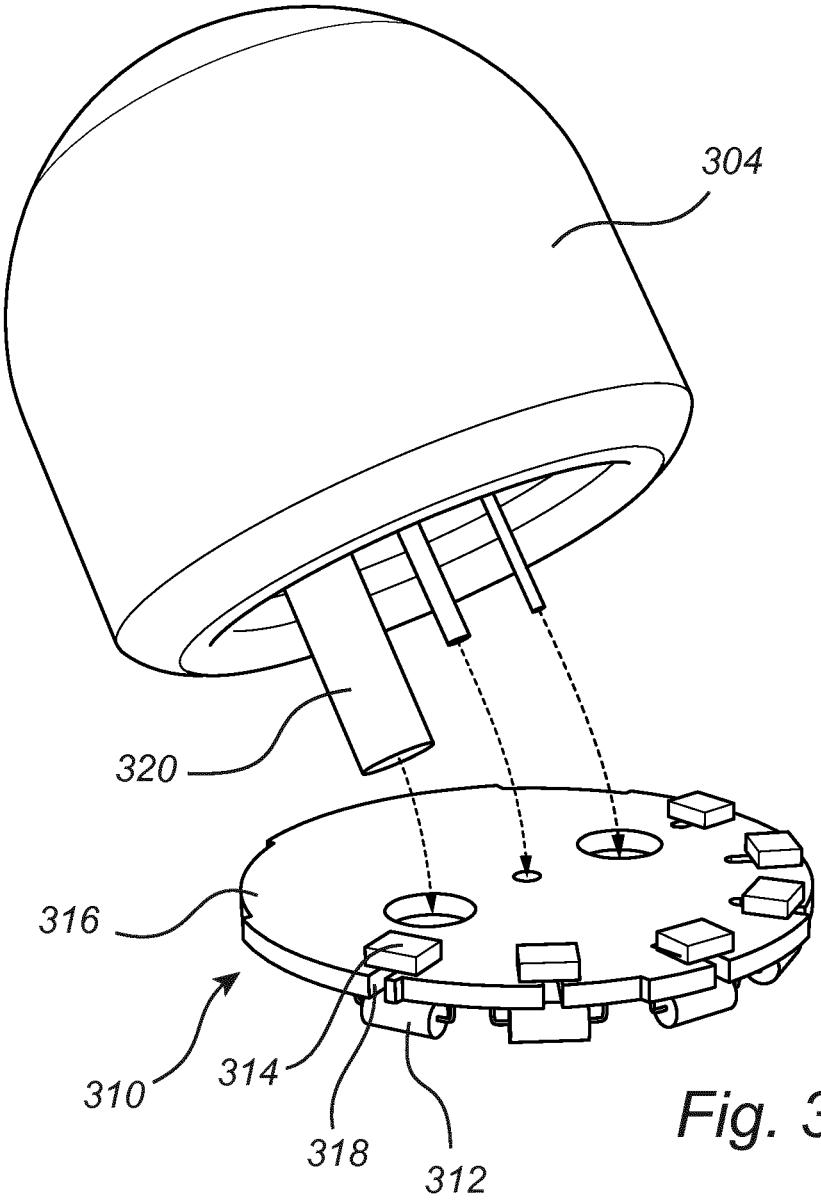

Turning now to FIGS. 3*a* and 3*b*, disclosing an overview as well as a detailed view, respectively, of an alternative embodiment of a lighting device 300, having a slightly different shape as compared to the lighting device 20 shown in FIG. 2, in line with the A-bulb concept and thus suitable as a retrofit for already available sockets/luminaires.

The lighting device 300, similarly as the lighting device 20 shown in FIG. 2, comprises a centrally arranged cathode 302 for example provided with a plurality of nanostructures, possibly based on the concept of ZnO nanostructures (not explicitly shown). The lighting device 300 further comprises a glass structure 304 covered on its inside with a transparent electrode layer (forming an anode electrode) and phosphor layer as is discussed above. Furthermore, the lighting device 300 comprises a cover 306, for example in the form of a diffusing plastic material enclosing the glass structure 304. A lamp base 308 is provided for installing the lighting device 300 in e.g. an Edison based socket. Other types of light bases are of course possible and within the scope of the invention. The lamp base 308 allows the lighting device 300 to be connected to the mains, e.g. an alternating voltage between 90-270 V @ 40-70 Hz. The lamp base 308 is in turn connected to an inventive power supply 310 integrated within the lighting device 300 as discussed above.

Turning now to FIG. 3*b*, illustrating a detailed view of portions of the integrated power supply 310 and the glass structure 304. In addition to the above discussion, a conceptual layout of the power supply may be see, including a plurality of diodes 312 and capacitors 314 of the above discussed voltage multiplier. In the illustrated embodiment, the diode 312 is provided on one side of a PCB of the power supply 310 and the capacitor is arranged on the other side of the PCB 316.

For increasing the electrical insulation between each of the pairs of diodes 312 and capacitors 314, the PCB 316 is provided with an air-gap 318 arranged at a periphery of the PCB 316 for each of the pairs of diodes 312 and capacitors 314. Arranging the pairs of diodes 312 and capacitors 314 in on different sides of the PCB 316 in combination with configuring the PCB 316 to comprise an air-gap 318 in the illustrated manner may decrease the total size of the power supply 310, thereby allowing for a compact lighting device 300 to be provided.

In addition, in the illustrated embodiment, a pump stem 320 of the evacuated glass structure 304 is arranged such that it, when mounted, "penetrates" the PCB 316, thereby allowing the pump stem 320 may be configured to be arranged adjacently to a light sensor (not shown), for example positioned on the side of the PCB 316 facing away from the glass structure 304. In the illustrated embodiment there has been illustrated three separate extensions (including pump stem 320) extending from the glass structure towards the PCB 316. Further extensions may of course be possible and within the scope of the invention, for example including the pump stem 316, an anode connection electrode, a cathode connection electrode as well as a getter extending out of the glass structure 304.

As discussed above, the light sensor may be provided for determining a normalized amount of light emitted by the lighting device for the purpose of allowing the emitted light to be e.g. kept steady at a predetermined light level.

The person skilled in the art realizes that the present invention by no means is limited to the preferred embodiments described above. On the contrary, many modifications and variations are possible within the scope of the appended claims. For example, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A power supply for a field emission lighting source, comprising:

a DC-DC converter configure to receive a source of direct current at a first voltage level, at an input of the DC-DC converter, and to provide a direct current at a second voltage level, at an output of the DC-DC converter, the second voltage level being higher than the first voltage level;

a resonant inverter comprising a transformer, the resonant inverter connected to the output of the DC-DC converter and configured to provide a pulsating signal at a first frequency having a third voltage level, the third voltage level being higher than the second voltage level, and a voltage multiplier rectifying the pulsating signal to a direct current at a fourth voltage level, the fourth voltage level being higher than the third voltage level, the voltage multiplier comprising a pair of output terminals for connecting to the field emission light source, wherein the power supply further comprises a control unit for controlling the resonant inverter based on a feedback relating to the operation of the field emission light source provide from the voltage multiplier, wherein the control unit is further configured to apply a PWM control of the resonant inverter for suppressing one or a plurality of pulses of the pulsating signal for adjusting the fourth voltage level provided to the field emission light source, and wherein a base frequency for the PWM control is selected as a multiple of a rectified mains signal provided to the DC-DC converter.

2. The power supply according to claim 1, wherein the DC-DC converter is a PFC-Boost converter.

3. The power supply according to claim 1, wherein the resonant inverter is at least one of an LLC or an LLCC inverter.

4. The power supply according to claim 1, further comprising an EMC filter.

5. The power supply according to claim 1, further comprising a capacitor connected to the output of the DC-DC converter, the capacitor having a capacitance lower than 0.15 uF/W, wherein the capacitor is a non-electrolytic capacitor.

6. The power supply according to claim 1, wherein the control unit is configured for allowing dynamic adjustment of the fourth voltage level.

7. The power supply according to claim 1, wherein the control unit is further configured to receive a signal representing a light intensity of the field emission light source, and control the amount of light emitted by the field emission light source based on the light intensity signal.

8. The power supply according to claim 7, wherein the control unit is further configured to further base the amount of light emitted by the field emission light source on a predetermined time based light emission curve.

9. A power supply for a field emission lighting source, comprising:

a DC-DC converter configure to receive a source of direct current at a first voltage level, at an input of the DC-DC converter, and to provide a direct current at a second voltage level, at an output of the DC-DC converter, the second voltage level being higher than the first voltage level;

a resonant inverter comprising a transformer, the resonant inverter connected to the output of the DC-DC converter and configured to provide a pulsating signal at a first frequency having a third voltage level, the third voltage level being higher than the second voltage level, and a voltage multiplier rectifying the pulsating signal to a direct current at a fourth voltage level, the fourth voltage level being higher than the third voltage level, the voltage multiplier comprising a pair of output terminals for connecting to the field emission light source, wherein the power supply further comprises a control unit for controlling the resonant inverter based on a feedback relating to the operation of the field emission light source provide from the voltage multiplier, and wherein the voltage multiplier comprises a plurality of pairs of diodes and capacitors arranged on opposite sides of a PCB of the power supply, respectively, wherein the PCB comprises a plurality of air-gap provided in relation to the pairs of diodes and capacitors for increasing an electrical insulation between the pair of diodes and capacitors.

10. A lighting device, comprising:

a field emission light source, comprising:

a field emission cathode;

an anode structure at least partly covered by a phosphor layer, said anode structure being configured to receive electrons emitted by the field emission cathode, and an evacuated chamber in which the field emission cathode and anode structure and field emission cathode is arranged, and a power supply comprising:

a DC-DC converter configure to receive a source of direct current at a first voltage level, at an input of the DC-DC converter, and to provide a direct current at a second voltage level, at an output of the DC-DC converter, the second voltage level being higher than the first voltage level, a resonant inverter comprising a transformer, the resonant inverter connected to the output of the DC-DC converter and configured to provide a pulsating signal at a first frequency having a third voltage level, the third voltage level being higher than the second voltage level, and a voltage multiplier rectifying the pulsating signal to a direct current at a fourth voltage level, the fourth voltage level being higher than the third voltage level, the voltage multiplier comprising a pair of output terminals for connecting to the field emission light source, wherein the power supply further comprises a control unit for controlling the resonant inverter based on a feedback relating to the operation of the field emission light source provide from the voltage multiplier, the power supply connected to the anode and the field emission cathode and configured to apply a voltage so that electrons are emitted from the cathode to the anode for emitting light.

11. The lighting device according to claim 10, wherein the power supply is integrated into a base of the field emission light source.

12. The lighting device according to claim 11, wherein the evacuated chamber comprises a pump stem for diverting a minor amount of light emitted by lighting device, wherein the power supply further comprise a light sensor for receiving light diverted by the pump stem.

13. The lighting device according to claim 10, wherein the evacuated chamber comprises a pump stem for diverting a minor amount of light emitted by lighting device, wherein the power supply further comprise a light sensor for receiving light diverted by the pump stem.

14. A method for controlling a power supply configured to apply an adjustable voltage level to a light source, the power supply comprising a resonant inverter, wherein the method comprises:

determining a frequency for a signal configured to provide an operational power for the power supply;

selecting a multiple of the frequency of the mains signal as a PWM base frequency;

controlling the resonant inverter to stop producing an output for a predetermined duration based on PWM control of the resonant inverter at the selected PWM base frequency, thereby allowing an average voltage level to the light source to be controlled for controlling the intensity level of the light source.

* * * * *